US008565646B2

(12) United States Patent
Suzuki

(10) Patent No.: US 8,565,646 B2
(45) Date of Patent: Oct. 22, 2013

(54) GEAR SYSTEM WITH TRANSMISSION PATHWAYS FOR AN IMAGE FORMING APPARATUS

(75) Inventor: Yasuhiro Suzuki, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 425 days.

(21) Appl. No.: 12/879,108

(22) Filed: Sep. 10, 2010

(65) Prior Publication Data

US 2011/0091237 A1 Apr. 21, 2011

(30) Foreign Application Priority Data

Oct. 20, 2009 (JP) ..... 2009-241438

(51) Int. Cl.
*G03G 15/00* (2006.01)

(52) U.S. Cl.
USPC ..... 399/167

(58) Field of Classification Search
USPC ..... 399/71, 101, 122, 167
See application file for complete search history.

(56) References Cited

U.S. PATENT DOCUMENTS

| | | | |
|---|---|---|---|
| 2007/0009284 | A1 | 1/2007 | Okamoto et al. |
| 2007/0053719 | A1 | 3/2007 | Kamimura et al. |
| 2007/0264065 | A1 | 11/2007 | Omura et al. |
| 2009/0092407 | A1 * | 4/2009 | Koie |
| 2009/0208242 | A1 | 8/2009 | Hayakawa |

FOREIGN PATENT DOCUMENTS

| | | | |
|---|---|---|---|
| JP | 03-152054 | | 6/1991 |
| JP | 2003-131464 | A | 5/2003 |
| JP | 2005-163826 | A | 6/2005 |
| JP | 2007-010838 | | 1/2007 |
| JP | 2007-072021 | | 3/2007 |
| JP | 2007-293219 | | 11/2007 |
| JP | 2008-216968 | A | 9/2008 |
| JP | 2009-198572 | A | 9/2009 |

OTHER PUBLICATIONS

JP Office Action dated Aug. 30, 2011, corresponding JP Application No. 2009-241438; English Translation.

* cited by examiner

*Primary Examiner* — Walter L Lindsay, Jr.
*Assistant Examiner* — Milton Gonzalez
(74) *Attorney, Agent, or Firm* — Banner & Witcoff, Ltd.

(57) ABSTRACT

An image forming apparatus is provided. The image forming apparatus includes electrostatic latent image carriers, developer devices, an endless belt, a cleaning roller, a first motor, a first gear train, being coupled to the cleaning roller to rotate in a predetermined direction when the first motor rotates in a first direction and decoupled from the cleaning roller when the first motor rotates in a second direction, a second gear train, being coupled to the cleaning roller to rotate in the predetermined direction when the first motor rotates in the second direction and decoupled from the cleaning roller when the first motor rotates in the first direction, and a third gear train, being coupled to at least one of the developer devices when the first motor rotates in the first direction and decoupled from the at least one of the developer devices when the first motor rotates in the second direction.

11 Claims, 9 Drawing Sheets

GEAR SYSTEM WITH TRANSMISSION PATHWAYS FOR AN IMAGE FORMING APPARATUS

CROSS REFERENCE TO RELATED APPLICATION

This application claims priority from Japanese Patent Application No. 2009-241438, filed on Oct. 20, 2009, the entire subject matter of which is incorporated herein by reference.

BACKGROUND

1. Technical Field

An aspect of the present invention relates to an image forming apparatus with an endless belt to form an image on a recording medium. More specifically, the present invention relates to an image forming apparatus having electrostatic latent image carriers, developer devices to form an image on a recording medium in cooperation with an endless belt, and a cleaning roller to clean the endless belt.

2. Related Art

An image forming apparatus having a plurality of electrostatic latent image carriers, each of which is provided for one of a plurality of different colors usable in the image forming apparatus, developer devices provided for the electrostatic latent image carriers respectively, and an endless belt to be driven in cooperation with the electrostatic latent image carriers has been known. In the known image forming apparatus, the electrostatic latent image carriers are driven to have electrostatic latent images formed on surfaces thereof. The developer devices provide adhesive developer agent to the electrostatic latent image formed on the surfaces of the electrostatic latent image carriers so that the latent image is developed to appear on the surfaces of the electrostatic image carriers. Meanwhile, the endless belt is driven to roll in a position opposed to the electrostatic latent image carriers and serves in cooperation with the electrostatic latent image carriers and the developer devices to transfer the developer agent on the electrostatic latent image carriers to a surface of the recording medium. When the image in multiple colors is formed on a same recording medium, the electrostatic latent image is formed on the surface of corresponding electrostatic latent image carrier for each color, and the developer device corresponding to the color provides the corresponding-colored developer agent (e.g., toner) to the electrostatic latent image.

The endless belt may be designed such that, for example, the developer agents adhered to the electrostatic latent image carriers are transferred onto a surface of the endless belt to be further transferred onto a surface of the recording medium. For another example, the recording sheet may be carried on the endless belt to have the developer agent on the electrostatic latent image carriers transferred onto its surface as the endless belt rolls.

When the developer agents in four colors (e.g., black, yellow, magenta, and cyan) are used in the image forming apparatus, four pairs of electrostatic latent image carrier and developer device for the four colors are required. However, driving the four pairs of electrostatic latent image carries and developer devices separately by separate motors may be disadvantageous in terms of, for example, manufacturing cost and downsizing the image forming apparatus. Meanwhile, the image forming apparatus may be used to form the image solely in the black (monochrome) developer agent, and the other pairs of electrostatic latent image carriers and the developer devices for yellow, magenta, and cyan (colored) developer agents may standby unused. In order to overcome such inefficiency, an image forming apparatus having a motor to collectively drive the developer devices for the colored developer agents and a motor to separately drive the developer device for the black developer agent is suggested.

SUMMARY

In the above way, some of the motors to drive the developer devices may be omitted; however, when the image forming apparatus employs the endless belt, the endless belt requires a cleaning roller to clean the surface of the endless belt, and the cleaning roller would require another driving motor. Accordingly, roller driving systems in the image forming apparatus tend to be complicated. In view of these deficiencies, the present invention is advantageous in that an image forming apparatus, in which the cleaning roller and at least one of the developer devices are driven commonly by a same driving motor, is provided.

According to an aspect of the present invention, an image forming apparatus is provided. The image forming apparatus includes a plurality of electrostatic latent image carriers, each of which is provided for forming an image in one of different colors and to have an electrostatic latent image formed on a surface thereof in the one of different colors, a plurality of developer devices, each of which is provided for one of the electrostatic latent image carriers, to supply developer agent in one of the different colors to apply to the electrostatic latent image formed on the surface of the electrostatic latent image carrier, an endless belt, which rolls continuously in a position opposite from the plurality of electrostatic latent image carriers and transfers the developer agent adhered on the surfaces of the electrostatic latent image carriers to a recording medium in cooperation with the electrostatic latent image carriers and the developer devices, a cleaning roller for cleaning the endless belt, a first motor, a first gear train, which is coupled to the cleaning roller to transmit driving force from the first motor to the cleaning roller for rotating the cleaning roller in a predetermined direction when the first motor rotates in a first direction and is decoupled from the cleaning roller when the first motor rotates in a second direction being a reverse direction from the first direction, a second gear train, which is coupled to the cleaning roller to transmit the driving force from the first motor to the cleaning roller for rotating the cleaning roller in the predetermined direction when the first motor rotates in the second direction and is decoupled from the cleaning roller when the first motor rotates in the first direction. and a third gear train, which is coupled to at least one of the developer devices to transmit the driving force from the first motor when the first motor rotates in the first direction and is decoupled from the at least one of the developer devices when the first motor rotates in the second direction.

According to an aspect of the present invention, an image forming apparatus is provided. The image forming apparatus includes a plurality of electrostatic latent image carriers, each of which is provided for forming an image in one of different colors and to have an electrostatic latent image formed in the one of different colors on a surface thereof, a plurality of developer devices, each of which is provided for one of the electrostatic latent image carriers, to supply developer agent in one of the different colors to apply to the electrostatic latent image formed on the surface of the electrostatic latent image carrier, an endless belt, which rolls continuously in a position opposite from the plurality of electrostatic latent image carriers and transfers the developer agent adhered on the surfaces of the electrostatic latent image carriers to a recording medium in cooperation with the electrostatic latent image carriers and the developer devices, a cleaning roller to be rotated in a predetermined direction to clean the endless belt, a conveyer to be driven by a conveyer driving system to supply the recording medium to the endless belt, a fixing unit to thermally fix the developer agent transferred to the recording medium thereon, a first motor to drive the conveyer, the cleaning roller, and at least one of the developer devices, and a second motor to drive remaining of the developer devices other than the at least one of the developer devices and the fixing unit.

According to an aspect of the present invention, an image forming apparatus is provided. The image forming apparatus includes a plurality of electrostatic latent image carriers, each of which is provided for forming an image in one of different colors and to have an electrostatic latent image formed in the one of different colors on a surface thereof, a plurality of developer devices, each of which is provided for one of the electrostatic latent image carriers and rotated in a predetermined direction to supply developer agent in one of the different colors to apply to the electrostatic latent image formed on the surface of the electrostatic latent image carrier, an endless belt, which rolls continuously and has an opposing section in a position opposite from the plurality of electrostatic latent image carriers to transfer the developer agent adhered on the surfaces of the electrostatic latent image carriers to a recording medium in cooperation with the electrostatic latent image carriers and the developer devices, a medium feeder, which includes a plurality of conveying rollers to convey the recording medium to the opposing section of the endless belt, a first motor to generate driving force, a first gear train, which includes a plurality of gears and at least one one-way clutch, to transmit the driving force from the first motor to at least one of the conveying rollers and to at least one of the developer devices, a second motor to generate driving force separately from the first motor, and a second gear train, which transmits the driving force generated in the second motor to one of remaining developer devices other than the at least one developer devices coupled with the first gear train. The at least one one-way clutch is in an intervening position between a gear coupled with the conveying rollers and a gear coupled with the at least one of the developer devices, and transmits driving force to rotate the at least one of the developer devices in the predetermined direction to the gear coupled with the conveying rollers and to the gear coupled with the at least one of the developer devices. The at least one one-way clutch absorbs driving force capable of rotating the at least one of the developer devices in a direction opposite from the predetermined direction within the first gear train.

According to an aspect of the present invention, an image forming apparatus is provided. The image forming apparatus includes an image forming unit for forming an image on a sheet in an electrophotographic process, an endless belt, a cleaning roller for cleaning the endless belt, a motor rotatable in a first direction and a second direction being a reverse direction from the first direction to generate driving force, a transmitting unit, which transmits the driving force from the motor to the cleaning roller to rotate the cleaning roller, and a gear train, which couples the image forming unit with the motor to transmit the driving force from the motor to the image forming unit when the motor rotates in the first direction and decouples the image forming unit from the motor when the motor rotates in the second direction. The transmitting unit is configured to rotate the cleaning roller in the first direction if the motor rotates in the first direction and rotate the cleaning roller in the first direction if the motor rotates in the second direction.

BRIEF DESCRIPTION OF THE ACCOMPANYING DRAWINGS

DETAILED DESCRIPTION

Hereinafter, an embodiment according to the present invention will be described with reference to the accompanying drawings.

Overall Configuration of Image Forming Apparatus

Figure 1:
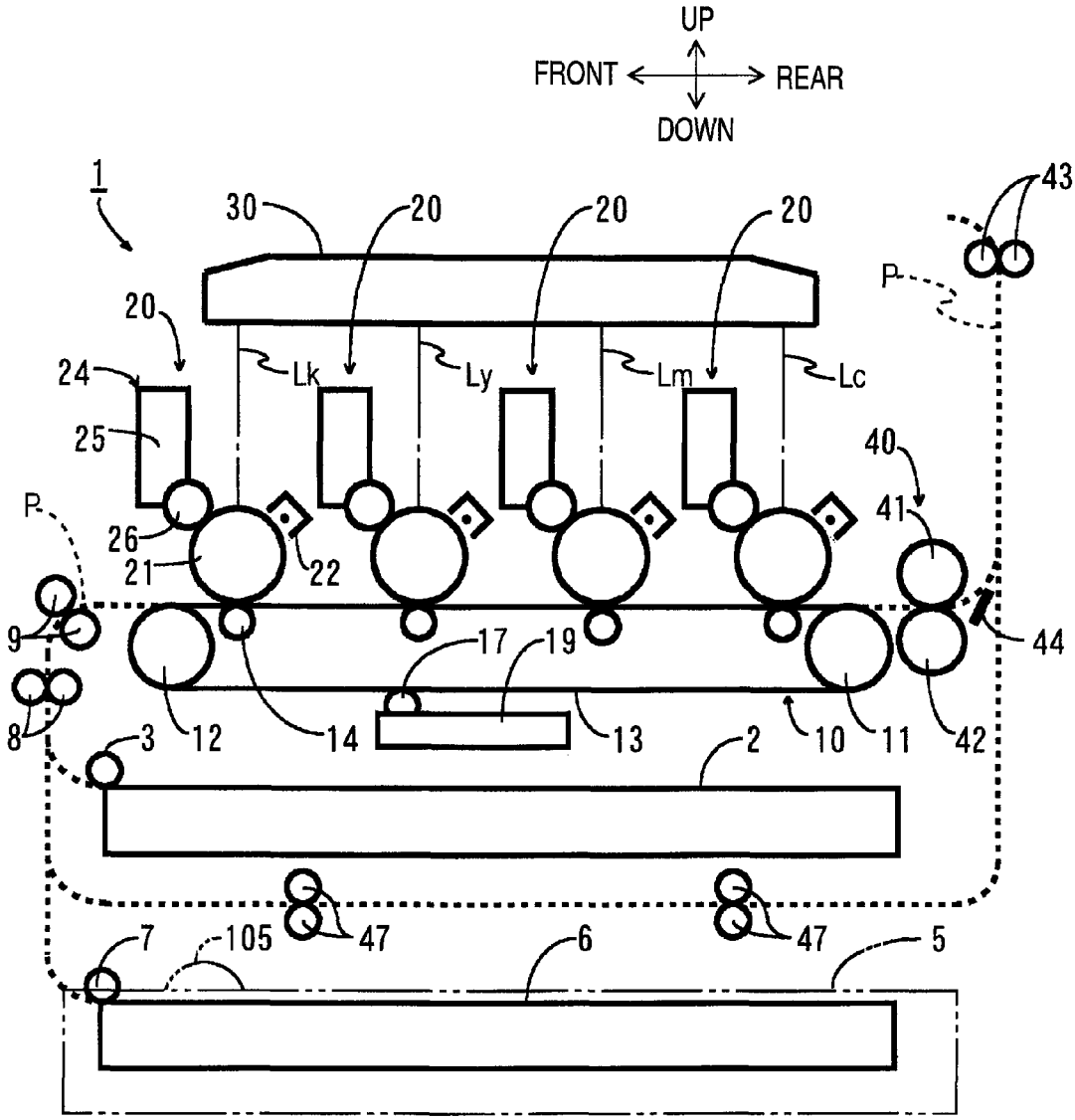
FIG. 1 is a schematic view of an image forming apparatus according to an embodiment of the present invention.

An overall configuration of an image forming apparatus 1 will be described with reference to FIG. 1. In the following description, directions concerning the image forming apparatus 1 will be referred to based on the orientation of the image forming apparatus 1 indicated in FIG. 1. The image forming apparatus 1 is a direct transfer tandem-typed electrophotographic color printer, having a sheet-feeding mechanism. The sheet feeding mechanism includes a sheet-feed tray 2, in which sheets of paper P being recording media are stored, at a lower section of a chassis (not shown). The sheet-feed tray 2 can be pulled forward out of the chasses to have, for example, new sheets P filled therein. In an upper front position with respect to the sheet-feed tray 2, a sheet-feed roller 3 to pick up and feed the sheets P in a feeding path is arranged. The sheet-feed roller 3 picks up the sheets P one-by-one out of the sheet-feed tray 2 and directs the picked-up sheets P to conveyer rollers 8, which will be described later in detail. The feeding path for the sheets P is indicated by dotted lines in FIG. 1.

Further, the image forming apparatus 1 is capable to have a lower-tray (LT) unit 5 attached in a lower section of the chasses. The LT unit 5 includes a sheet-feed tray 6 and a sheet-feed roller 7, which are similar to the sheet-feed tray 2 and the sheet-feed roller 3 respectively. The sheet-feed roller 7 picks up sheets P one-by-one out of the sheet-feed tray 6 and directs the picked-up sheets P to conveyer rollers 8. The conveyer rollers 8 being a pair are driven by a roller driving system, which will be described later, to convey the sheets P to a pair of register rollers 9. The register rollers 9 convey the sheets P carried by the conveyer rollers 8 to a belt unit 10 according to predetermined operation timing.

The image forming apparatus 1 is equipped with a belt unit 10, which includes a driving roller 11, a driven roller 12, and a conveyer belt 13 being an endless belt. The conveyer belt 13 is arranged to roll around the driving roller 11 and the driven roller 12. In positions above the belt unit 10, four processing units 20 for four colors, which are black (K), yellow (Y), magenta (M), and cyan (C), are detachably installed in line in a front-rear direction in the order given.

Each of the processing units 20 is provided with a different colored developer agent, which is one of black, yellow, magenta, and cyan. Other than the colors of the developer agents provided, the processing units 20 have substantially same structures and functions. In particular, each of the processing units 20 includes a photosensitive drum 21 to carry an electrostatic latent image, a charger 22, and a developer cartridge 24. The photosensitive drum 21 has a drum body made of a metal and a positively-chargeable photosensitive layer covering the drum body.

The charger 22 is arranged in an upper rear position with respect to the photosensitive drum 21 to oppose to the photosensitive drum 21 but to be spaced apart from a circumferential surface thereof with a predetermined amount of clearance there-between. The charger 22 is a scorotron charger to generate corona discharge from a charger wire, such as a tungsten wire, to positively charge the surface of the photosensitive drum 21. The developer cartridge 24 has a toner container 25, in which nonmagnetic mono-component toner being a developer agent for one of black, cyan, magenta, and yellow is stored. The toner is positively friction-charged in the toner container 25 and supplied to the photosensitive drum 21 via a developer roller 26.

The belt unit 10 includes four transfer rollers 14, which are in positions opposing to the photosensitive drums 21 with the conveyer belt 13 intervening there-between. The belt unit 10 further includes a cleaning unit 19, which has a cleaning roller 17 to be rotated in a predetermined direction (e.g., a counter-clockwise in FIG. 1) to remove the toners and dust from the surface of the conveyer belt 13 and clean the surface. The conveyer belt 13 is rolled endlessly in a direction of rotation of the driving roller 11 as the driving roller 11 rotates in a clockwise direction (in FIG. 11). The conveyer belt 13 is supplied with a sheet P of paper by the register rollers 9, and the sheet P is carried on the surface of the conveyer belt 13 underneath the photosensitive drums 21 according to the rolling movement.

The image forming apparatus 1 includes a scanner unit 30 in an upper section above the processing units 20. The scanner unit 30 has semiconductor laser emitters (not shown) to emit laser beams Lk, Ly, Lm, Lc for image data of the K, Y, M, C colors and polygon mirrors (not shown) to deflect the laser beams Lk, Ly, Lm, Lc. The deflected laser beams Lk, Ly, Lm, Lc are directed to the photosensitive drums 21, and the surface layers of the photosensitive drums 21 are exposed to the laser beams Lk, Ly, Lm, Lc respectively.

According to the above structure, the surface of each photosensitive drum 21 is initially charged by the charger 22 uniformly as the photosensitive drum 21 rotates. Thereafter, the surface the photosensitive drum 21 is exposed to the laser beam L emitted from the scanner unit 30 to scan the surface of the uniformly charged photosensitive drum 21 according to image data, which represents an image to be formed on the sheet P. Thus, a region on the surface exposed to the laser beam L gains lower potential due to an effect of the laser beam L and forms a latent image. Next, as the developer roller 26 rotates, and the positively-charged toner on the developer roller 26 comes in contact with the surface of the photosensitive drum 21, the toner on the developer roller 26 is transferred to be adhered to the lower-potential region, which corresponds to the latent image formed on the surface of the photosensitive drum 21. Accordingly, the latent image is developed to be a toner image on the surface of the photosensitive drum 21. The toner images formed on the surfaces of the photosensitive drums 21 are transferred respectively to be overlaid on the surface of the sheet P, which is carried by the conveyer belt 13, by a predetermined level of negative transfer bias applied to the transfer rollers 14. The sheet P with the transferred four colored toner images is conveyed to a fixing unit 40, in which the four colored images are thermally fixed to the surface of the sheet P.

The fixing unit 40 includes a heat roller 41 with a heat source (e.g., a halogen lamp) to be rotated by a driving force and a pressure roller 42, which are arranged in parallel to oppose each other. The pressure roller 42 is pressed against the heat roller 41 to be rotated along with the rotation of the heat roller 41. The sheet P with the overlaid four-colored toner images is carried in between the heat roller 41 and the pressure roller 42, and the heat roller 41 applies the heat to the sheet P. Accordingly, the toner images are thermally fixed onto the sheet P, and the sheet P is carried further by discharge rollers 43, 43 to be ejected onto a discharge tray (not shown), which is arranged on a top surface of the chassis of the image forming apparatus 1.

A flapper 44 is arranged in the feeding path between the fixing unit 40 and the discharge rollers 43 in a position where the feeding path is branched. The feeding path further from the fixing unit 40 includes a route to carry the sheet P in a direction from the fixing unit 40 toward the discharge rollers 43 and a returning route to carry the sheet P in a returning direction from the discharge rollers 43 toward recurrence rollers 47. The flapper 44 changes its position to switch the route for the sheet P. The image forming apparatus 1 includes a plurality of pairs of recurrence rollers 47 in positions lower than the sheet-feed tray 2, and the recurrence rollers 47 carry the sheet P in the returning path again toward the register rollers 9.

When images are to be formed on both sides of the sheet P, the flapper 44 is firstly set in a position to direct the sheet P, having a toner image formed on an upper side, to the discharge rollers 43. Accordingly, the sheet P is carried upward by the fixing unit 40 and the discharge rollers 43 rotating in normal directions. Secondly, after a rear end of the sheet P passes by the flapper 44, the discharge rollers 43, 43 are rotated in reverse directions, and the flapper 44 is shifted in a position to direct the sheet P in the returning route toward the recurrence rollers 47.

Accordingly, the sheet P is carried by the recurrence rollers 47 to return to the register rollers 9. In this regard, the sheet P is carried by the register rollers 9 to the conveyer belt 13 with its reverse side facing up toward the photosensitive drums 21. The sheet P on the conveyer belt 13 is processed to have toner images transferred on the reverse side, and the toner images are thermally fixed by the fixing unit 40 on the reverse side. Thus, the images are formed on the both sides of the sheet P, and the sheet P is discharged out of the chassis by the discharge rollers 43.

Roller Driving System

Figure 2:
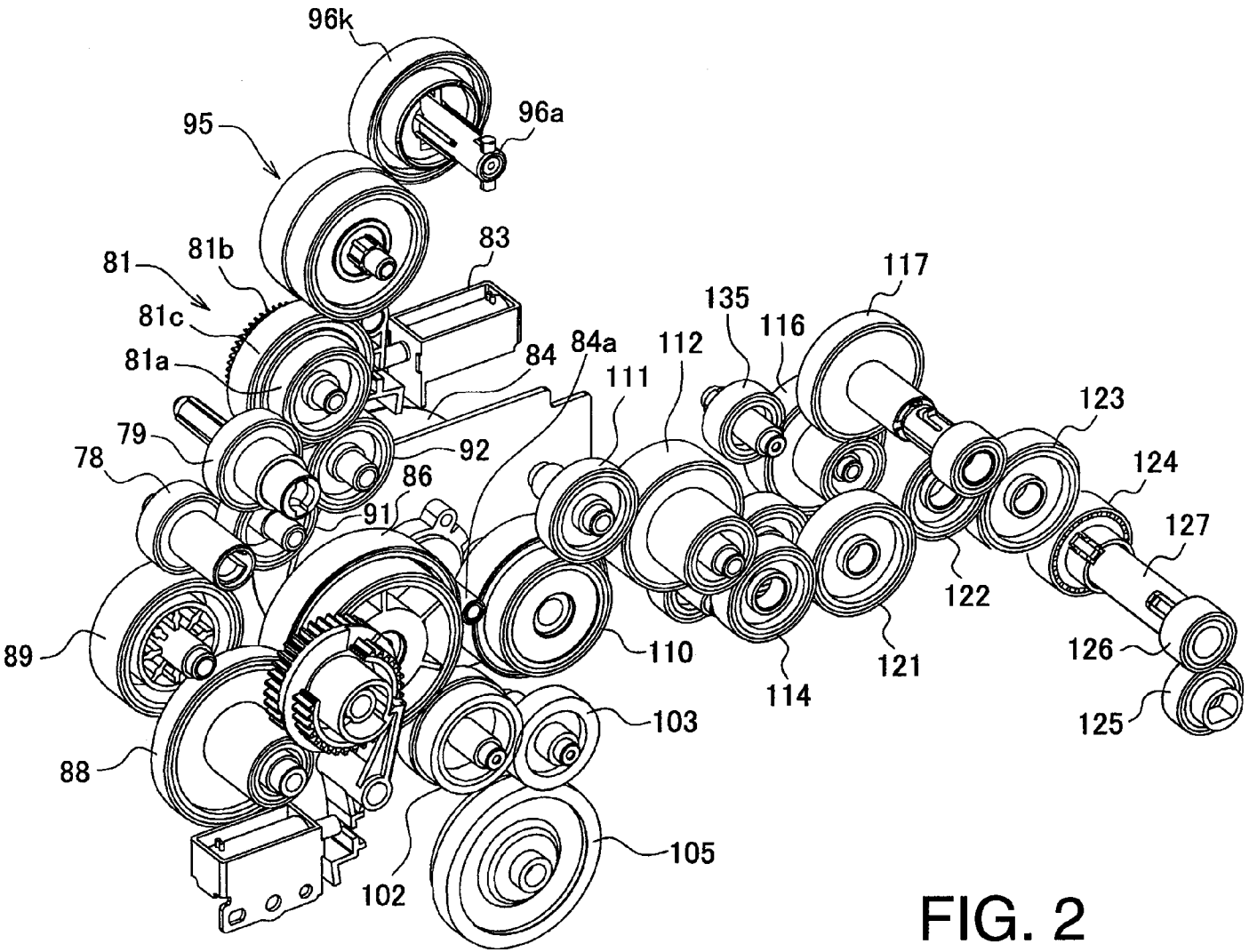
FIG. 2 is a perspective view of a roller driving system in the image forming apparatus according to the embodiment of the present invention.

A configuration of a system to drive the rollers will be described hereinbelow. As shown in FIGS. 2 and 3A, the roller driving system includes a conveyer roller driving gear 78, which is rotatable integrally with the conveyer rollers 8, and a register roller driving gear 79, which is rotatable integrally with the register rollers 9. In FIGS. 2-10, some gears are represented by disk-like shapes, and teeth of the gears are omitted.

The register roller driving gear 79 is in engagement with a ring gear 81*a* of a clutch gear 81. The ring gear 81*a* is formed to have internal teeth (not shown) on an inner periphery thereof. The internal teeth are in engagement with a plurality of planet gears (not shown). The planet gears are in engagement with a sun gear (not shown), which is integrally rotatable with a sun gear 81*b* (see FIG. 3A). The plurality of planet gears are held by a planetary carrier 81*c*, of which outer periphery is formed to have external teeth (not shown).

When a first hook 82 (see FIG. 3A) is hooked to the sun gear 81*b* to restrain the sun gear 8l*b* from being rotated, the sun gear not shown is also restrained. Therefore, when driving force is transmitted to the planetary carrier 81c, the planetary carrier 81*c* drives the planet gears not shown to rotate and revolve around the restrained sun gear not shown. The movement of the planet gears rotates the ring gear 81*a*, and the rotation of the ring gear 81*a* is transmitted further to the register roller 9 via the register roller driving gear 79. On the other hand, when the first hook 82 is unhooked to release the sun gear 81*b*, the rotation of the planetary carrier 81*c* drives the planet gears to rotate, and the rotation of the planet gears is transmitted to the sun gear 81*b* to idle. Accordingly, the rotation is absorbed and not transmitted to the ring gear 81*a*, and the ring gear 81*a* is prevented from being rotated.

The first hook 82 is swingable about a shaft 82*a* according to expanding and contracting motions of a solenoid 83, which is arranged in a position behind the first hook 82 (see FIG. 3A). The solenoid 83, when electrically disconnected, swings the first hook 82 upward to be engaged with the sun gear 81*b*. When electrically conducted, the solenoid 83 swings the first hook 82 downward to be disengaged from the sun gear 81*b*.

The roller driving system is provided with a motor 84, which generates driving force to be transmitted to the ring gear 81*a* of the clutch gear 81. When a driving gear 84*a*, which is fixed to a rotation shaft of the motor 84, is rotated in a normal direction, which is in the clockwise direction in FIGS. 2 and 4, the driving force from the motor 84 is transmitted to the ring gear 81*a*. The transmission of the driving force from the motor 84 will be described hereinbelow.

Figure 3B:
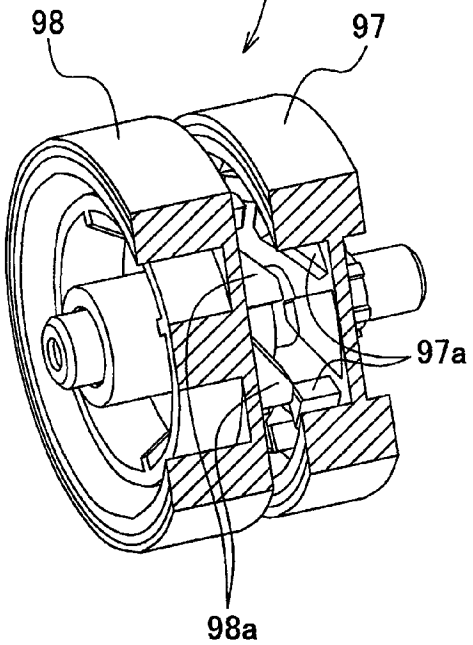
FIGS. 3A and 3B are a perspective view and a cross-sectional view of the roller driving system in the image forming apparatus in different angles according to the embodiment of the present invention.
Figure 3A:
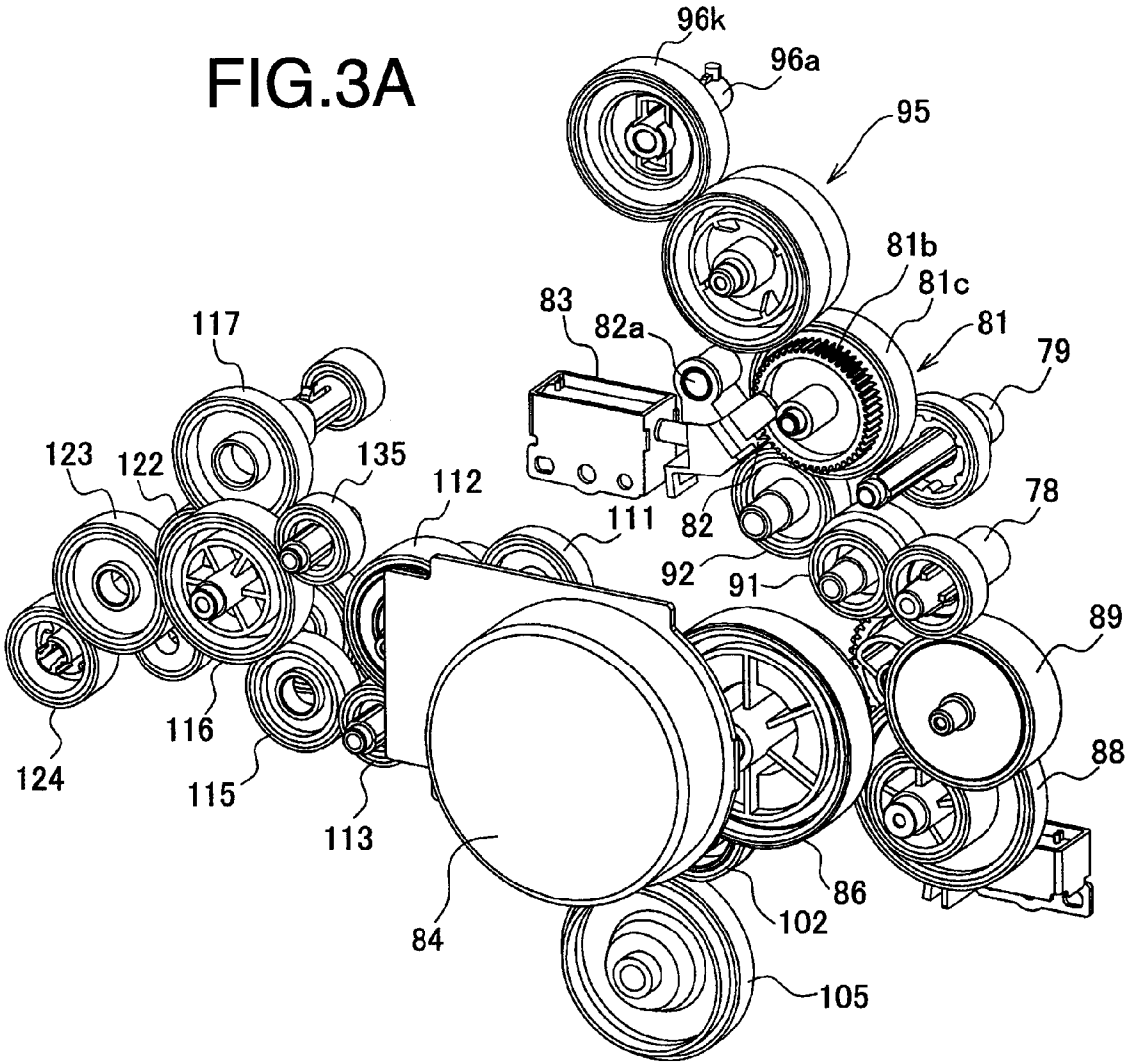
Figure 4:
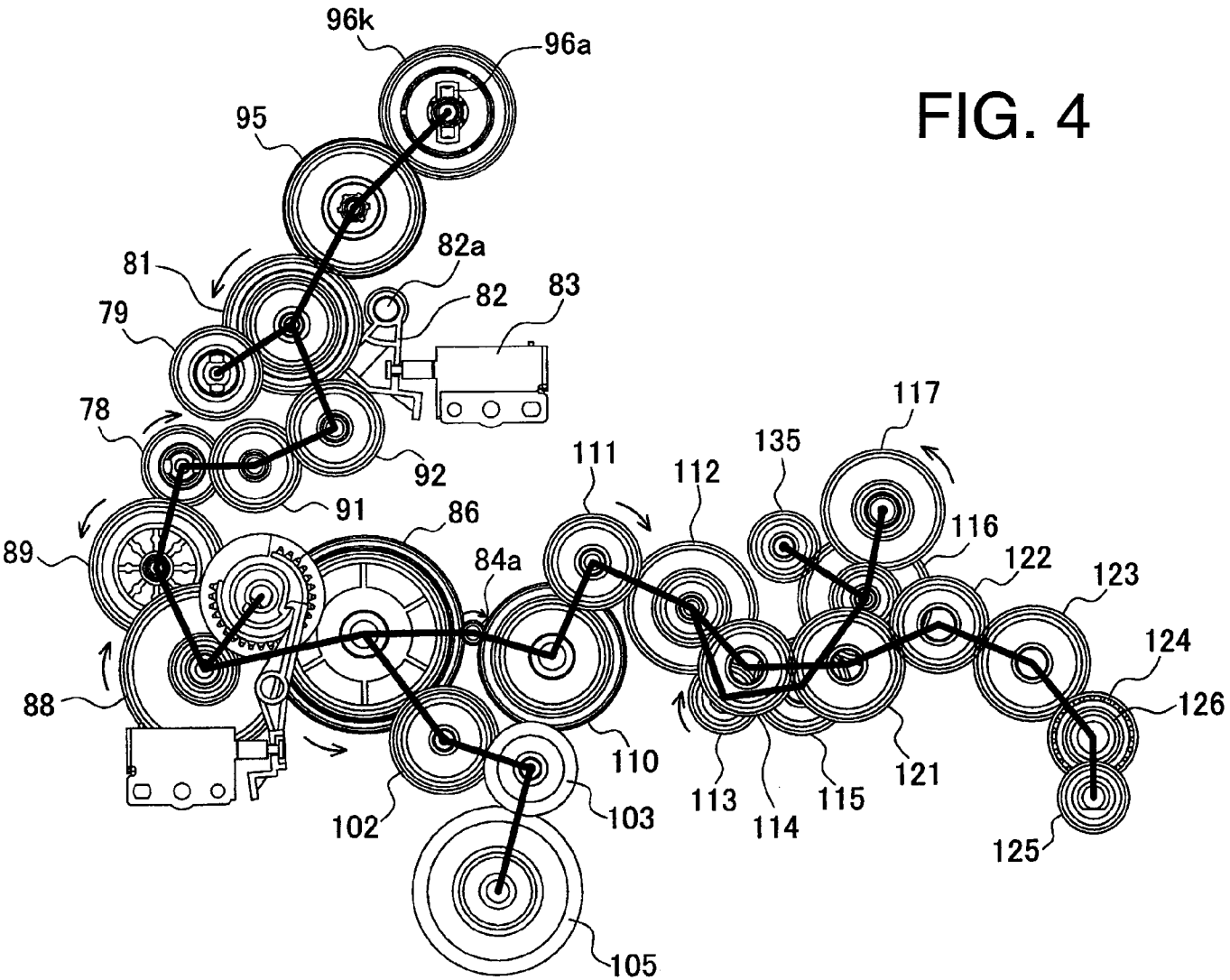
FIG. 4 is a side view of the roller driving system in the image forming apparatus to illustrate transmission pathway of driving force from a motor in normal rotation according to the embodiment of the present invention.
Figure 6:
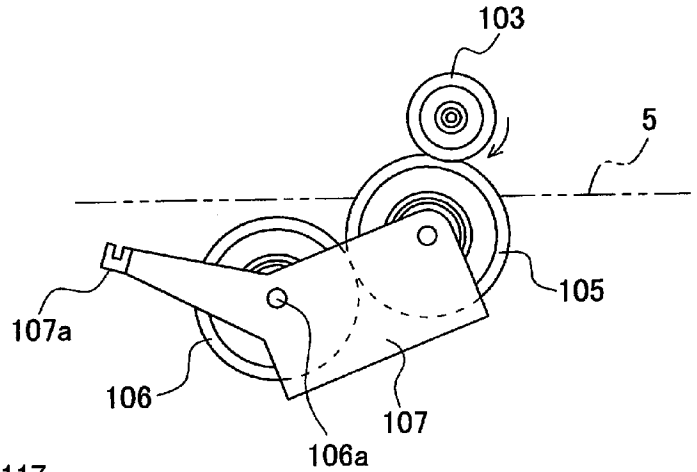
FIG. 6 is a side view of an LT unit gear and relevant parts in the roller driving system according to the embodiment of the present invention.

As shown in FIGS. 2-4, the rotation of the driving gear 84*a* is transmitted to reduction gears 86, 88, each of which has a larger diameter section and a smaller diameter section, and to a pendulum gear 89. The pendulum gear 89 is a known pendulum gear, which maintains its engagement with the reduction gear 88 and swingable about a rotation axis of the reduction gear 88. When the driving gear 84*a* is in normal rotation, the pendulum gear 89 swings rightward (in FIG. 4) to become engaged with the conveyer roller driving gear 78. At the same time, the conveyer roller driving gear 78 is interlocked with the planetary carrier 81*c* via an acceleration gear 91, having a smaller diameter section and a larger diameter section, and an idle gear 92.

Therefore, when the motor 84 is in normal rotation, the conveyer roller driving gear 78 is rotated in the clockwise direction (in FIG. 4) via a train of gears, which include the reduction gear 86, the reduction gear 88, and the pendulum gear 89. Simultaneously, the planetary carrier 81*c* is rotated in the counterclockwise direction (in FIG. 4). In this regard, when the solenoid 83 is electrically disconnected, the first hook 82 is hooked with the sun gear 81*b*, and the register roller 9 is rotated. When the solenoid 83 is conducted, the sun gear 81*b* rotates, and the register roller 9 is prevented from being rotated.

The planetary carrier 81*c* is further interlocked with a developer roller driving gear 96*k* via a one-way clutch 95, which can absorb to intercept reverse rotation force transmitted to the one-way clutch 95. The developer roller driving gear 96*k* drives the developer roller 26 for black, which is to develop an image in black, to rotate via a drive coupling 96*a*.

The one-way clutch 95, shown in FIG. 3B, is provided with an input gear 97 and an output gear 98, which are coupled together by contracting force of a spring (not shown). The input gear 97 and the output gear 98 are formed to have a pair of engaging pieces 97*a*, 98*a* respectively. The pair of engaging pieces 97*a* of the input gear 97 includes a parallel plane, which is in parallel with a rotation axis of the one-way clutch 95, and an inclined plane, which is inclined with respect to the rotation axis. Similarly, the pair of engaging pieces 98*a* of the output gear 98 includes a parallel plane and an inclined plane. The parallel planes of the input gear 97 and the output gear 98 become in contact with each other when the motor 84 is in normal rotation.

When the motor 84 is in normal rotation, therefore, the driving force is transmitted from the planetary carrier 81*c* to the output gear 98 through the input gear 97 and the engagement of the parallel planes of the engaging pieces 97*a*, 98*a*. Meanwhile, when the input gear 97 is rotated in the reverse direction, the inclined planes of the engaging pieces 97*a*, 98*a* are not in engagement with each other; therefore, the reverse rotation force of the input gear 97 is prevented from being transmitted to the output gear 98. Accordingly, when the conveyer rollers 8 and/or the register rollers 9 are manipulated to rotate in a reverse direction opposite from the normal sheet-feeding direction manually by a user, who is, for example, dealing with a sheet jam, the reverse rotation of the conveyer rollers 8 and/or the register rollers 9 is prevented from being transmitted to the developer roller driving gear 96*k*, and the developer roller 26 for black image-forming is prevented from being rotated in the reverse direction. Further, the reverse rotation of the conveyer rollers 8 and the register rollers 9 is prevented from being transmitted to the motor 84 when the motor 84 has been preliminarily rotated in a reverse direction for a substantial amount to keep the pendulum gear 89 away from the conveyer roller driving gear 78 (see below).

When the driving gear 84*a* fixed to the rotation shaft of the motor 84 rotates in the reverse direction (i.e., the counterclockwise in FIG. 5), the pendulum gear 89 swings leftward (see FIG. 5) to become apart from the conveyer roller driving gear 78. Accordingly, the reverse driving force from the motor 84 is not transmitted further from the pendulum gear 89 to the conveyer rollers 8 or the register rollers 9. Therefore, the conveyer rollers 8 and the register rollers 9 remain not rotated regardless of the contraction or expansion of the solenoid 83.

The driving gear 84*a* is in engagement with the reduction gear 86 and with a pendulum gear 102 (see FIGS. 2-5). The pendulum gear 102 maintains its engagement with the reduction gear 86 and at the same time swingable about a rotation axis of the reduction gear 86. When the driving gear 84*a* is in normal rotation, the pendulum gear 102 swings rightward (in FIG. 4) to become engaged with an LT unit driving gear 103. The LT unit driving gear 103 is a gear to be engaged with an LT unit gear 105 (see FIG. 1), which is exposed from an upper edge of the LT unit 5, when the LT unit 5 is attached to the chassis of the image forming apparatus 1 to drive the sheet-feed roller 7 to rotate.

The LT unit gear 105 and an idle gear 106, which are in engagement with each other, are rotatably held by a holder 107. The holder 107 is swingably supported by the LT unit 5 to swing about a rotation shaft 106*a* of the idle gear 106. The holder 107 includes a hook 107*a* on an edge opposite from a side on which the LT unit gear 105 is provided. The hook 107*a* is hooked with a spring (not shown) to be resiliently pulled downward. Therefore, the idle gear 106 is rotatably supported by the holder 107 in a predetermined position in the LT unit 5. The driving force transmitted to the idle gear 106 via the LT unit gear 105 is further transmitted to gears not shown and to the sheet-feed roller 7 to rotate.

The LT unit gear 105 is pressed to the LT unit driving gear 103 by contracting force of the spring hooked with the hook 107*a*. When the driving gear 84*a* rotates in the normal direction and the LT unit driving gear 103 is rotated in the clockwise direction (in FIG. 6), force to move the LT unit gear 105 toward the LT unit driving gear 103 is generated by the engagement. Therefore, when the driving gear 84*a* is in normal rotation, the LT unit driving gear 103 and the LT unit gear 105 are more securely engaged with each other.

When the driving gear 84*a* is in the reverse rotation, on the other hand, the pendulum gear 102 swings to become apart from the LT unit driving gear 103 (see FIG. 5); therefore, the driving force is not transmitted further from the pendulum gear102 to the LT unit gear 105. When, for example, the LT unit driving gear 103 is rotated in the counterclockwise direction in FIG. 6, force to move the LT unit gear 105 apart from the LT unit driving gear 103 is generated by the engagement. Therefore, the engagement of the LT unit driving gear 103 and the LT unit gear 105 may be loosened. When the tooth of the LT unit gear 105 and the LT unit driving gear 103 are not meshed regularly or securely, the driving force may be prevented from being transmitted from the LT unit driving gear 103 to the LT unit gear 105. Accordingly, the sheet-feed roller 7 may be prevented from being rotated in a reverse direction, which is opposite from a normal rotation to carry the sheet P for image forming in the sheet-feeding path. However, the loosened and irregular meshing of the teeth may cause undesirable noise whilst the driving gear 84*a* is in the reverse rotation. Therefore, in the present embodiment, the pendulum gear 102 is arranged to intervene in the pathway of force transmission so that the reverse rotation of the driving gear 84*a* is distinctly prevented from being transmitted to the LT unit driving gear 103.

Referring back to FIGS. 2-5, remaining gears in the roller driving system will be described. The driving gear 84*a* is in engagement with a reduction gear 110, which is arranged on a side opposite from the reduction gear 86. The reduction gear 110 is interlocked with a pendulum gear 112 via an idle gear 111. The pendulum gear 112 maintains its engagement with the idle gear 111 and at the same time swingable about a rotation axis of the idle gear 111. The pendulum gear 112 also functions as a reduction gear, when the driving gear 84*a* is in normal rotation, to swing downward to become apart from an idle gear 135 and in engagement with idle gears 113, 114 simultaneously.

The idle gear 113 is interlocked with a belt cleaner driving gear 117 via an idle gear 115 and a reduction gear 116. The belt cleaner driving gear 117 drives the cleaning roller 17 via a plurality of idle gears (not shown). When the motor 84 is in normal rotation, the driving force is transmitted to the cleaning roller via a train of gears including the reduction gear 110, the idle gear 111, the pendulum gear 112, the idle gears 113, 114, 115, the reduction gear 116, and the belt cleaner driving gear 117. As the belt cleaner driving gear 117 is rotated in the counterclockwise direction (in FIG. 4), the cleaning roller 17 is rotated in the predetermined direction for cleaning the surface of the conveyer belt 13.

The idle gear 114 is further interlocked with an idle gear 124 via idle gears 121, 122, 123. The idle gear 124 is rotatable in synchronization with a DX unit driving gear 126 via a shaft 127, which is in engagement with a DX unit gear 125. The DX unit gear 125 is a gear to drive the recurrence rollers 47 via a plurality of gears (not shown). Therefore, when the motor 84 is in normal rotation, the recurrence rollers 47 are rotated simultaneously.

Figure 5:
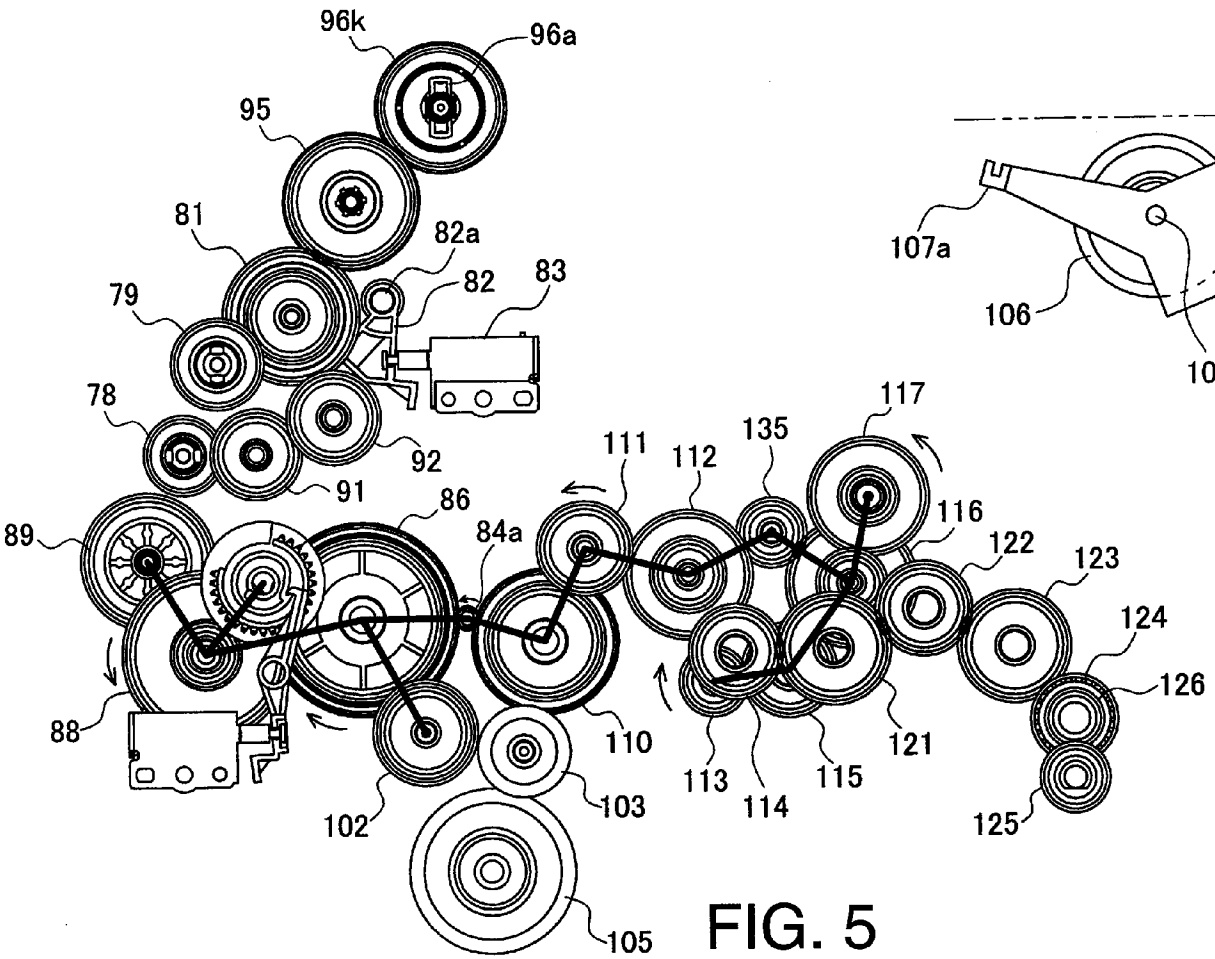
FIG. 5 is a side view of the roller driving system in the image forming apparatus to illustrate transmission pathway of driving force from the motor in reverse rotation according to the embodiment of the present invention.
Figure 7:
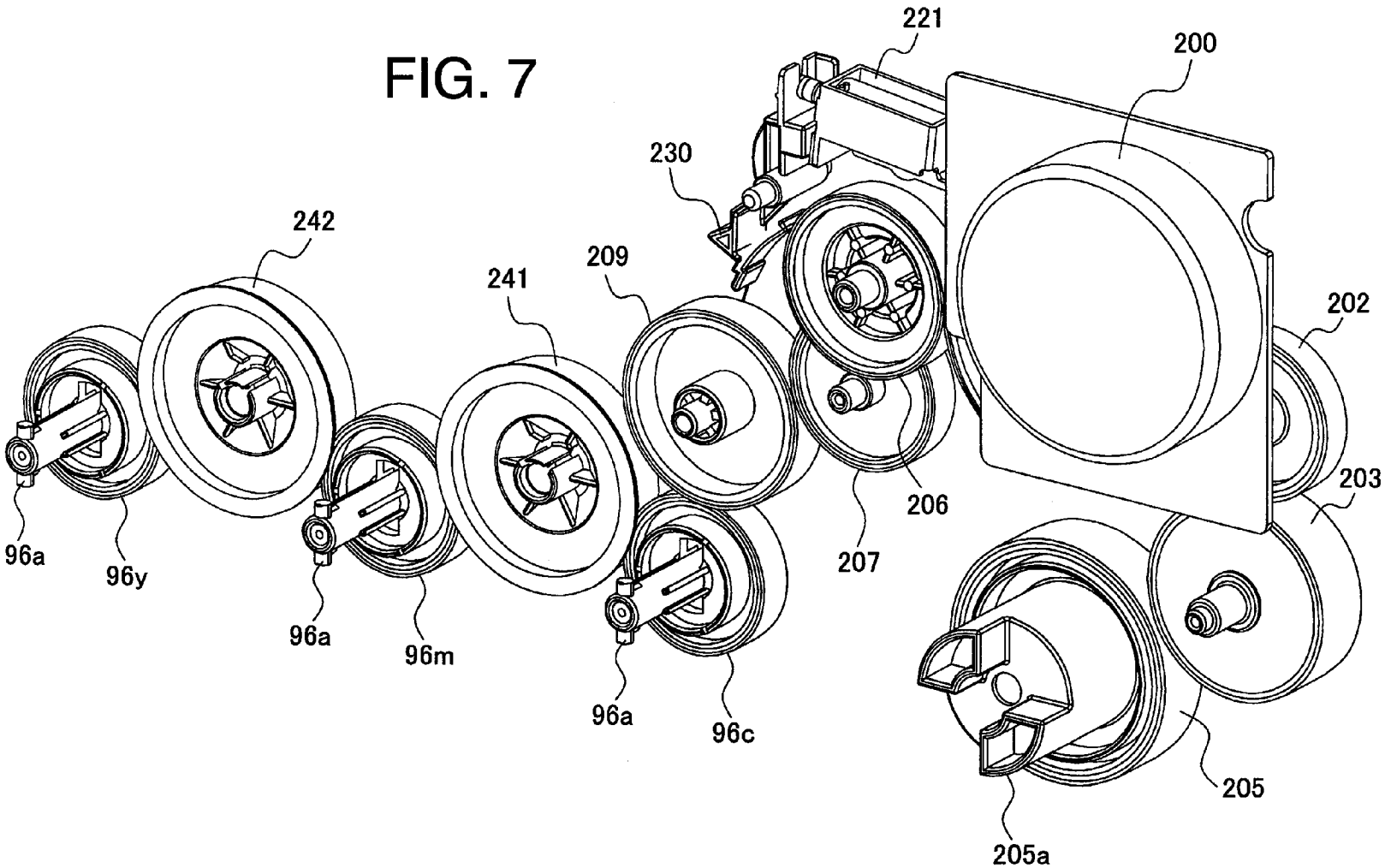
FIG. 7 is a perspective view of a fixing unit driving system in the image forming apparatus according to the embodiment of the present invention.
Figure 8A:
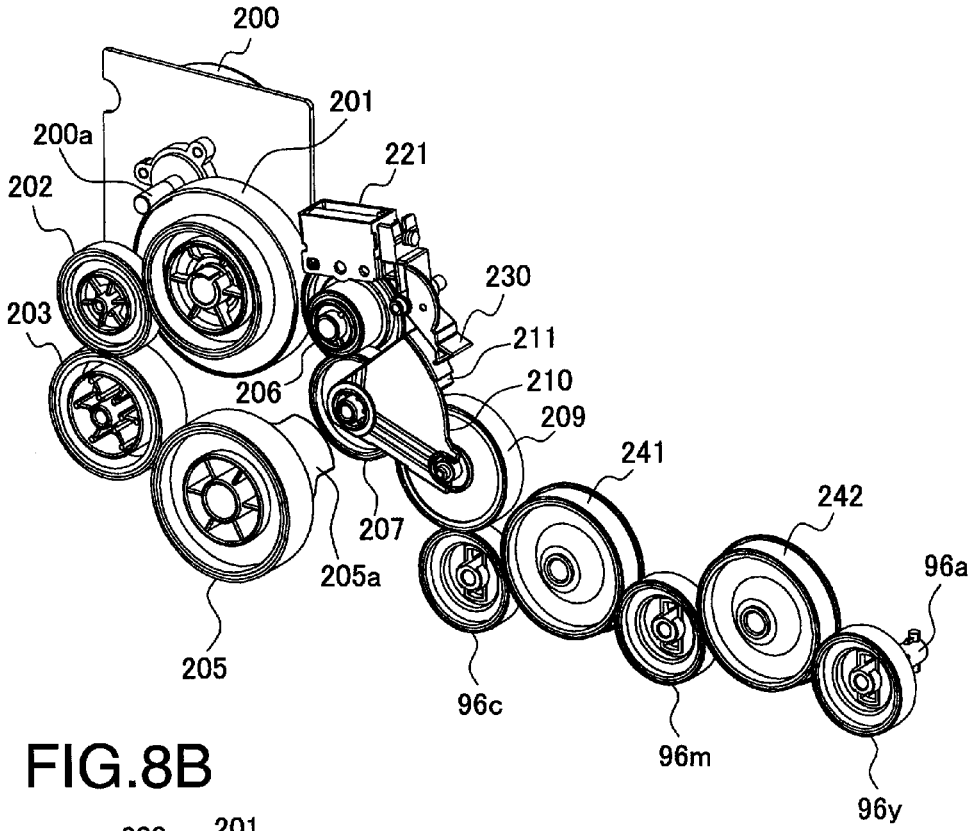
FIGS. 8A and 8B are a perspective view and a side view of the fixing unit driving system to illustrate behaviors of rollers when a motor is normal rotation and a second hook is released from a hooking section in the image forming apparatus according to the embodiment of the present invention.
Figure 8B:
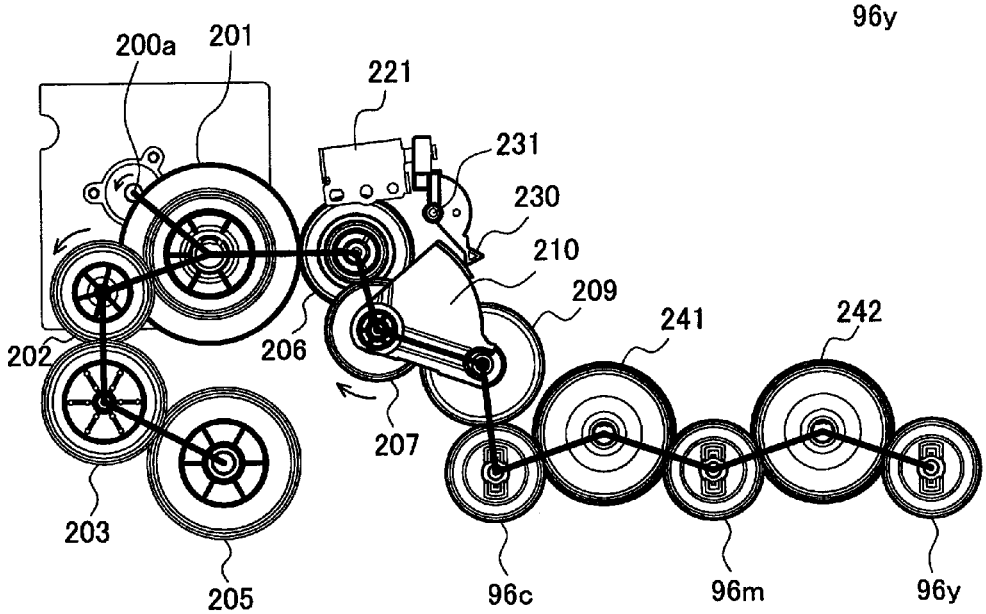
Figure 9A:
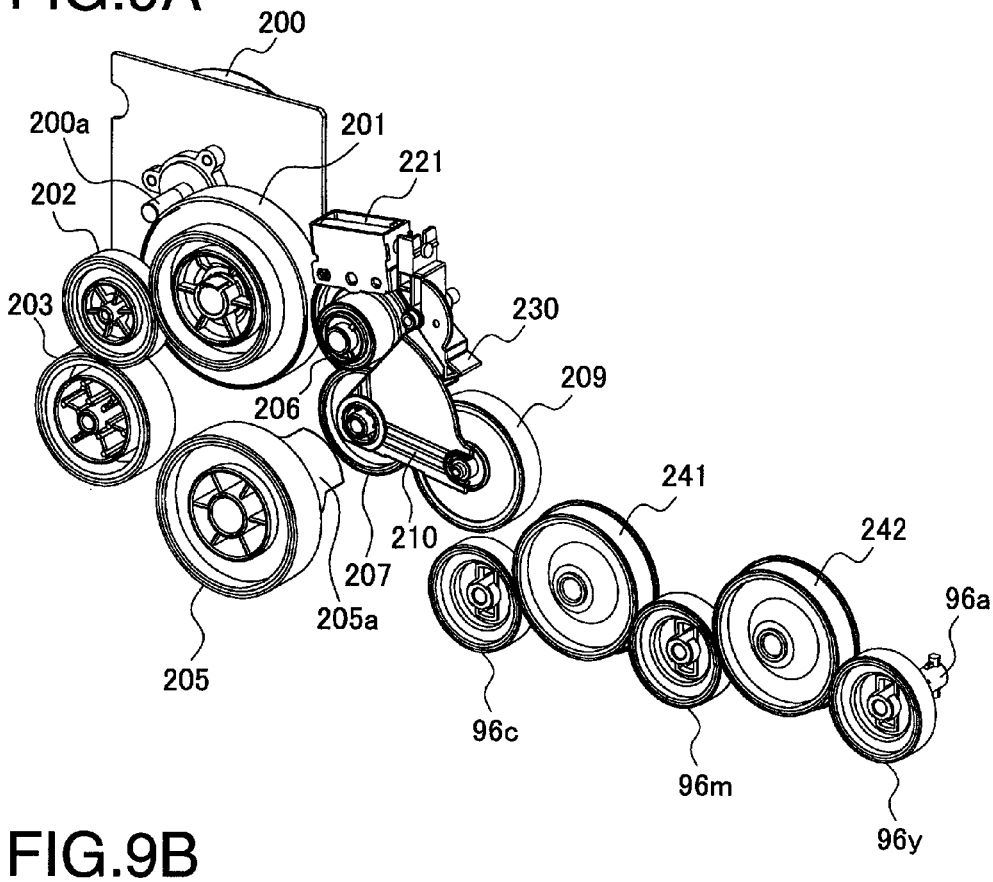
FIGS. 9A and 9B are a perspective view and a side view of the fixing unit driving system to illustrate behaviors of the rollers when the motor is in reverse rotation and the second hook is hooked with the hooking section in the image forming apparatus according to the embodiment of the present invention.
Figure 9B:
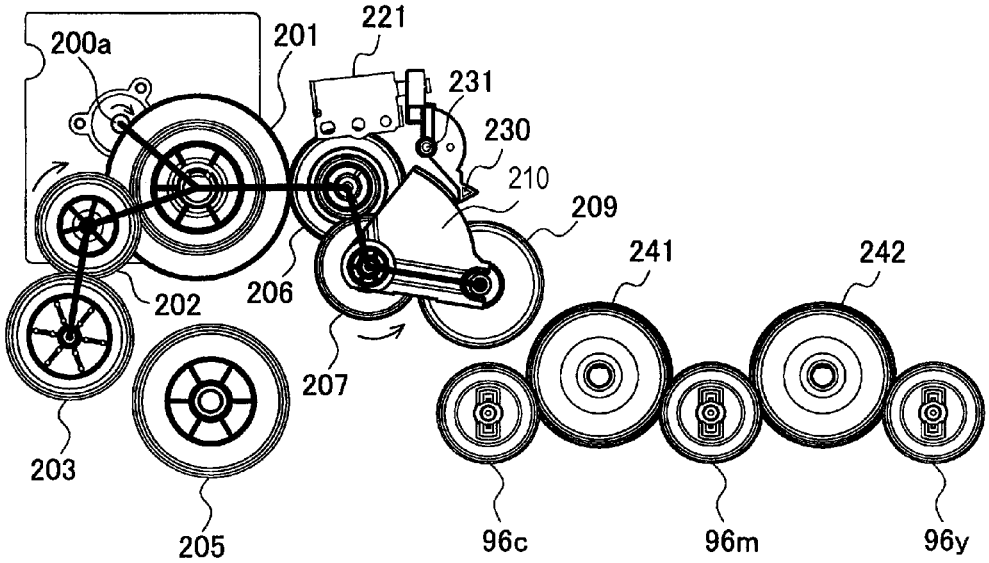
Figure 10A:
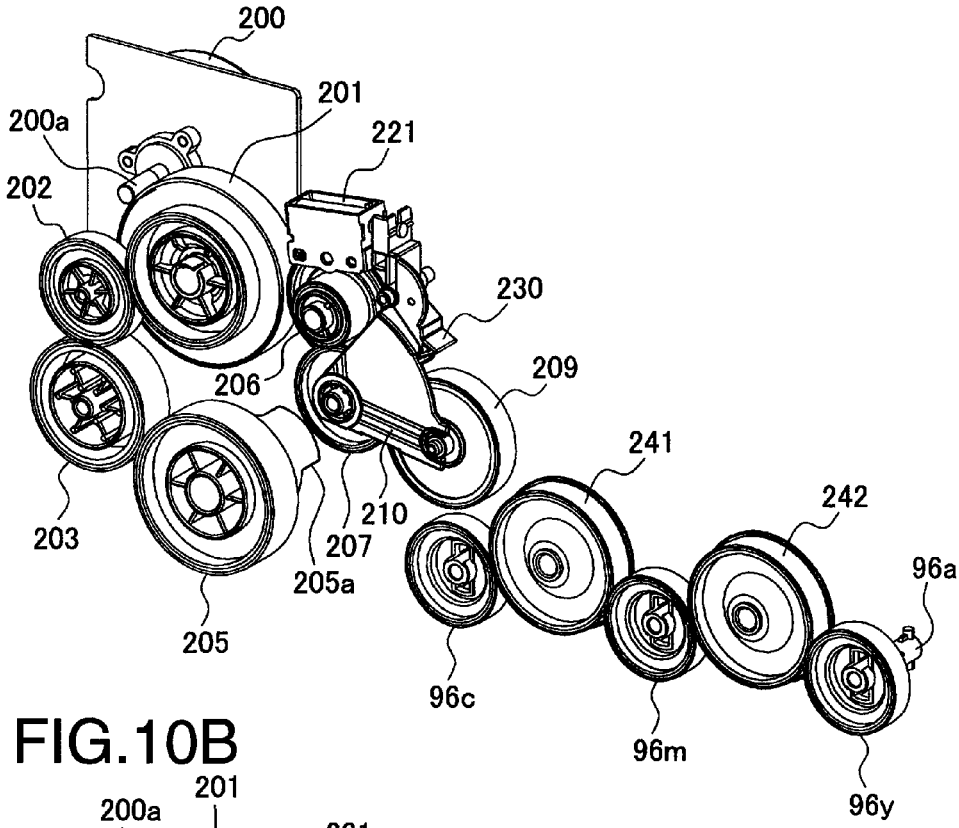
FIGS. 10A and 10B are a perspective view and a side view of the fixing unit driving system to illustrate behaviors of the rollers when the motor is in normal rotation and the second hook is hooked with the hooking section in the image forming apparatus according to the embodiment of the present invention.
Figure 10B:
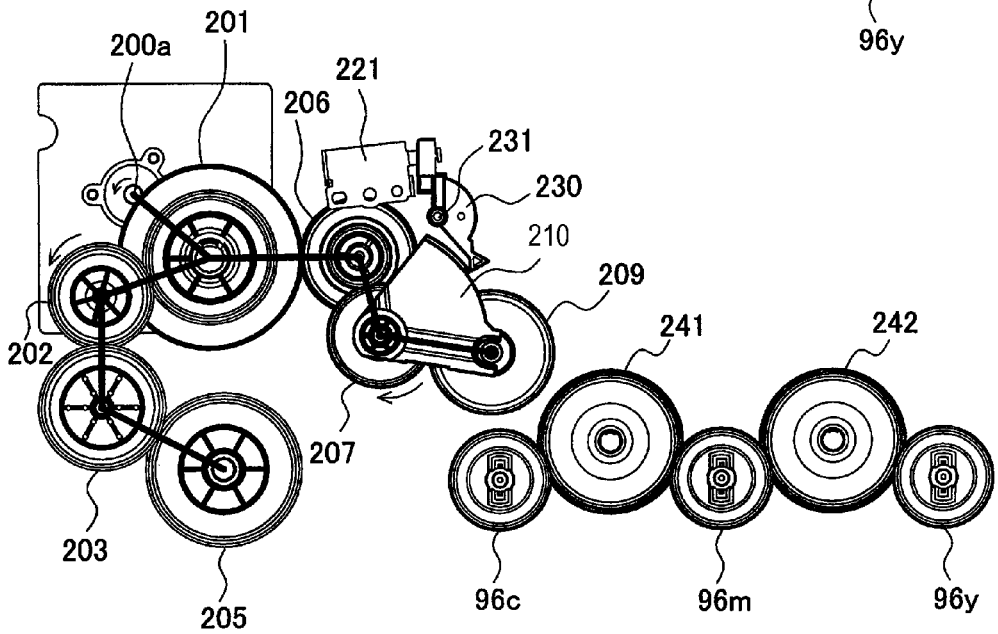

When the driving gear 84*a* is in reverse rotation, the pendulum gear 112, as shown in FIG. 5, swings upward to become apart from the idle gears 113, 114 and in engagement with the idle gear 135, which is in engagement with the reduction gear 116. Accordingly, reverse rotation of the motor 84 is transmitted to the cleaning roller 17 via a train of gears including the reduction gear 110, the idle gear 111, the pendulum gear 112, the idle gear 135, the reduction gear 116, and the belt cleaner driving gear 117 to rotate the cleaning roller 17 in the predetermined direction.

Configuration of Driving System for Fixing Unit

Configurations of developer rollers 26 for cyan, magenta, and yellow (colored) image-forming, and a driving system for the heat roller 41 in the fixing unit 40 will be described with reference to FIGS. 7-10.

The fixing unit driving system is provided with a motor 200, which generates driving force to activate the fixing unit driving system. The motor 200 is provided with a driving gear 200*a*, which is fixed to a rotation shaft of the motor 200 and is in engagement with a reduction gear 201 having a larger diameter section and a smaller diameter section. The smaller diameter section of the reduction gear 201 is interlocked with a pendulum gear 203 via an idle gear 202. The pendulum gear 203 maintains its engagement with the idle gear 202 and at the same time is swingable about a rotation axis of the idle gear 202. When the motor 200 is in normal rotation, i.e., counterclockwise in FIG. 8B, the pendulum gear 203 swings rightward (in FIG. 8B) to become engaged with a fixing roller driving gear 205. The fixing roller driving gear 205 drives the heat roller 41 via a drive coupling 205*a* (see FIG. 7).

The larger diameter section of the reduction gear 201 is interlocked with a pendulum gear 209 via a reduction gear 206, having a larger diameter section and a smaller diameter section, and an idle gear 207. The pendulum gear 209 is rotatably supported by a holder 210, which is swingable about a rotation axis of the idle gear 207. The pendulum gear 209 maintains its engagement with the idle gear 207 and at the same time swingable about a rotation axis of the idle gear 207. The holder 210 is formed to have an arc-shaped top edge with a hooking section 211 (see FIG. 8A). When the pendulum gear 209 swings upward (see FIGS. 9A and 9B), the hooking section 211 is engageable with a second hook 230, which is swingable about a shaft 231 according to contraction and expansion of a solenoid 221.

When the hooking section 211 is released from the second hook 230, and when the motor 200 is in normal rotation, the pendulum gear 209 swings downward (see FIG. 8B) to be engaged with a developer roller driving gear 96*c*. The developer roller driving gear 96*c* drives the developer roller 26 for cyan image-forming to rotate via a driver coupling 96*a* (see FIG. 7). The developer roller driving gear 96*c* is interlocked with a developer roller driving gear 96*m* via an idle gear 241, and the developer roller driving gear 96*m* is further interlocked with a developer roller driving gear 96*y* via an idle gear 242. The developer roller driving gears 96*m*, 96*y* drive the developer rollers 26 for magenta image-forming and yellow image-forming to rotate respectively. Therefore, when a colored image is formed in the four colored toners, the developer rollers 26 for cyan, magenta, and yellow image-forming can be driven simultaneously by having the hooking section 211 released from the second hook 230 and activating the motor 200 in the normal direction. In this regard, the heat roller 41 is rotated simultaneously by the same motor 200.

When the motor 200 is activated to rotate in a reverse direction (i.e., clockwise in FIG. 9B), the developer roller driving gear 96*c* and the fixing unit driving gear 205 are disengaged from the pendulum gear 209 and the pendulum gear 203 respectively. More specifically, the pendulum gear 203 swings leftward (in FIG. 9B) to become apart and disengaged from the fixing unit driving gear 205; therefore, the driving force is disconnected and prevented from being transmitted to the heat roller 41. That is, the heat roller 41 is not rotated. At the same time, the pendulum gear 209 swings upward to become apart and disengaged from the developer roller driving gear 96*c*. With the pendulum gear 209 uplifted, the hooking section 211 can be hooked with the second hook 230 by the expanding effect of the solenoid 221. When the hooking section 211 is hooked with the second hook 230, the pendulum gear 209 is maintained in the uplifted position and disengaged from the developer roller driving gear 96*c*. Whilst the pendulum gear 209 is disengaged from the developer roller driving gear 96*c*, the driving force from the motor 200 in the reverse direction is disconnected, and the developer rollers 26 for cyan, magenta, and yellow image-forming are prevented from being rotated in the reverse direction. In other words, both the heat roller 41 and the developer rollers 26 for cyan, magenta, and yellow image-forming are disconnected from the motor 84. From this disconnected state, solely the heat roller 41 can be again connected with the motor 84 in the following behaviors.

That is, when the motor 200 is activated to rotate again in the normal direction with the second hook 230 hooked with the hooking section 211 (see FIGS. 10A and 10B), the pendulum gear 209 remains disengaged from the developer roller driving gear 96*c* whilst the pendulum gear 203 becomes again engaged with the fixing roller driving gear 205. Accordingly, the heat roller 41 is rotated whilst the developer rollers 26 for cyan, magenta, and yellow image-forming remain disconnected. Therefore, the heat roller 41 can be driven separately from the cyan, magenta, and yellow image-forming. In this regard, when the first motor 84 is activated to drive the roller driving system including the developer roller 26 for black image-forming, the register rollers 9, and the cleaning roller 17, monochrome image-forming in black can be carried out. Thus, the heat roller 41 can be driven either separately from the developer rollers 26 for cyan, magenta, and yellow image-forming or along with the developer rollers 26 for cyan, magenta, and yellow image-forming simultaneously by the motor 200, and the separation and the simultaneous movement of the heat roller 41 and the developer rollers for cyan, magenta, and yellow image-forming can be switched by the direction of rotation of the motor 200 and the effect of the solenoid 221.

Further, when sheet-jam occurs in the image forming apparatus 1, the motor 200 may be rotated in the reverse direction for a substantial amount preliminarily so that the pendulum gear 203 is disengaged from the fixing roller driving gear 205. Thus, the jammed sheet P, which is nipped between the heat roller 41 and the pressure roller 42, can be easily pulled out of the image forming apparatus 1.

Effects and Variations of the Embodiment

As has been described above, in the image forming apparatus 1, normal rotation of the motor 84 drives the conveyer rollers 8, the register rollers 9, and the cleaning roller 17 in the predetermined direction. Further, the developer roller 26 for black image-forming is driven to rotate in the normal direction for the image-forming. Meanwhile, reverse rotation of the motor 84 drives none of the conveyer rollers 8, the register rollers 9, the developer roller 26 for black image-forming, or the recurrence roller 47 but drives the cleaning roller 17 in the same predetermined direction. Therefore, for example, the motor 84 can be activated to rotate in the reverse direction specifically for cleaning the conveyer belt 13 so that the developer rollers 26 are prevented from being rotated during the cleaning. Accordingly, inappropriate consumption of the toners can be prevented. The cleaning of the conveyer belt 13 in the above embodiment may be conducted in a so-called OPC (organic photoconductor) cleaning method, in which residual toner remaining on the surface of the photosensitive drum 21 is collected by an OPC cleaning roller (not shown) during an image-forming operation, and after a predetermined number of image-forming operations, the residual toner on the OPC cleaning roller is retrieved via the photosensitive drum 21 and the conveyer belt 13 to be stored in the cleaning unit 19.

In the above embodiment, the developer roller 26 for black image-forming, the conveyer rollers 8, the register rollers 9, the cleaning roller 17, and the recurrence roller 47 are commonly activated by the motor 84 whilst the remaining developer rollers 26 for cyan, magenta, and yellow image-forming and the heat roller 41 are commonly activated by the motor 200. The transmission pathways of the driving forces can be switched according to directions of rotation of the motors 84, 200; therefore, no additional switching mechanism, such as a clutch or a solenoid, is required. In other words, an image forming apparatus with roller driving systems in simple configurations can be achieved. In consequence, manufacturing cost and a size of the image forming apparatus can be reduced. Further, in the image forming apparatus 1, the motor 84 activates the conveyer rollers 8, the register rollers 9, and the developer roller 26 for black image-forming, which is arranged in a position closest to the conveyer rollers 8 and the register rollers 9 amongst the developer rollers 26 for cyan, magenta, yellow, and black image-forming. Meanwhile, the motor 200 activates the developer rollers 26 for cyan, magenta, and yellow image-forming and the heat roller 41, which is closer to the developer rollers 26 for cyan, magenta, and yellow image-forming than the developer roller for black image-forming. Therefore, the driving forces can be maintained with less decay and effectively transmitted.

According to the above embodiment, with the second hook 230 hooked with the hooking section 211, when the motors 84, 200 are rotated in the normal direction, the developer roller 26 for black image-forming and the heat roller 41 are rotated whilst the developer rollers 26 for cyan, magenta, and yellow image-forming are maintained unmoved. Accordingly, a monochrome image in black toner can be formed.

Although an example of carrying out the invention have been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, transmission and disconnection of the driving force can be switched by, for example, one-way clutches within the gear trains. However, the switching mechanism based on the directions of rotation of the motors is more effective in simplifying the roller driving systems in the image forming apparatus 1 when transmission and disconnection of the driving force is switched by pendulum gears, such as the pendulum gears 89, 112 in the above embodiment, and when the train of gears 110, 111, 112, 113, 114, 115, 116, 117 and the train of gears 110, 111, 112, 135, 116, 117 commonly include the gears 110-112.

For another example, the endless belt, which is employed to serve as the conveyer belt 13 in the image forming apparatus 1 in the above embodiment, may be used as, for example, an intermediate transfer belt. Further, the developer roller 26 for black image-forming to be activated by the motor 84 commonly with the cleaning roller 17 may be replaced with one or more of the other developer rollers 26 for cyan, magenta, and yellow image-forming.

What is claimed is:

1. An image forming apparatus, comprising:

a plurality of electrostatic latent image carriers, each of which is provided for forming an image in one of different colors and configured to have an electrostatic latent image formed on a surface thereof in the one of different colors;

a plurality of developer devices, each of which is provided for one of the electrostatic latent image carriers and configured to supply developer agent in one of the different colors to apply to the electrostatic latent image formed on the surface of the electrostatic latent image carrier;

an endless belt configured to roll continuously in a position opposite from the plurality of electrostatic latent image carriers and transfer the developer agent adhered on the surfaces of the electrostatic latent image carriers to a recording medium in cooperation with the electrostatic latent image carriers and the developer devices;

a cleaning roller configured to clean the endless belt;

a first motor;

a first gear train, which is coupled to the cleaning roller to transmit driving force from the first motor to the cleaning roller for rotating the cleaning roller in a predetermined direction when the first motor rotates in a first direction and is decoupled from the cleaning roller when the first motor rotates in a second direction being a reverse direction from the first direction;

a second gear train, which is coupled to the cleaning roller to transmit the driving force from the first motor to the cleaning roller for rotating the cleaning roller in the predetermined direction when the first motor rotates in the second direction and is decoupled from the cleaning roller when the first motor rotates in the first direction;

a third gear train, which is coupled to at least one of the developer devices to transmit the driving force from the first motor when the first motor rotates in the first direction and is decoupled from the at least one of the developer devices when the first motor rotates in the second direction;

a conveyer configured to be driven by a conveyer driving system to supply the recording medium to the endless belt; and a second motor configured to drive remaining ones of the developer devices other than the at least one of the developer devices, wherein the third gear train is coupled to the at least one of the developer devices and to the conveyer to transmit the driving force from the first motor when the first motor rotates in the first direction and is decoupled from the at least one of the devices and from the conveyer when the first motor rotates in the second direction; and wherein the at least one of the developer devices is arranged in a position closer to the conveyer driving system than the remaining ones of the developer devices.

2. The image forming apparatus according to claim 1, wherein the conveyer is movable in a normal direction and in a reverse direction opposite from the normal direction, the normal direction being a direction to be rotated by rotation of the first motor rotating in the first direction; and wherein the third gear train includes a reverse rotation interceptor configured to intercept reverse movement of the conveyer within the third gear train and prevent the reverse movement from being transmitted to the at least one of the developer devices.

3. The image forming apparatus according to claim 1, further comprising:

a fixing unit configured to thermally fix the developer agent transferred to the recording medium thereon, wherein the fixing unit is driven by driving force from the second motor.

4. The image forming apparatus according to claim 3, further comprising:

a disconnection unit configured to disconnect the remaining ones of the developer devices from the second motor and allow the driving force from the second motor to be transmitted to the fixing unit, wherein the fixing unit is driven by the second motor separately from the remaining ones of the developer devices whilst the disconnection unit is activated.

5. The image forming apparatus according to claim 1, wherein the first gear train and the second gear train commonly include a pendulum gear, which couples the first gear train and the second gear to the first motor;

wherein the first gear train includes an odd number of gears;

wherein the second gear train includes an even number of gears;

wherein the pendulum gear couples the first gear train to the first motor when the first motor rotates in the first direction; and wherein the pendulum gear couples the second gear train to the first motor when the first motor rotates in the second direction.

6. An image forming apparatus, comprising:

a plurality of electrostatic latent image carriers, each of which is provided for forming an image in one of different colors and configured to have an electrostatic latent image formed in the one of different colors on a surface thereof;

a plurality of developer devices, each of which is provided for one of the electrostatic latent image carriers and configured to supply developer agent in one of the different colors to apply to the electrostatic latent image formed on the surface of the electrostatic latent image carrier;

an endless belt configured to roll continuously in a position opposite from the plurality of electrostatic latent image carriers and transfer the developer agent adhered on the surfaces of the electrostatic latent image carriers to a recording medium in cooperation with the electrostatic latent image carriers and the developer devices;

a cleaning roller configured to be rotated in a predetermined direction to clean the endless belt;

a conveyer configured to be driven by a conveyer driving system to supply the recording medium to the endless belt;

a fixing unit configured to thermally fix the developer agent transferred to the recording medium thereon;

a first motor to drive the conveyer, the cleaning roller, and at least one of the developer devices; and a second motor to drive remaining ones of the developer devices other than the at least one of the developer devices and the fixing unit.

7. The image forming apparatus according to claim 6, further comprising:

a disconnection unit configured to disconnect the remaining ones of the developer devices from the second motor and allow the driving force from the second motor to be transmitted to the fixing unit, wherein the fixing unit is driven by the second motor separately from the remaining ones of the developer devices whilst the disconnection unit is activated.

8. An electrophotographic image forming apparatus, comprising:

a plurality of electrostatic latent image carriers, each of which is provided for forming an image in one of different colors and to have an electrostatic latent image formed in the one of different colors on a surface thereof;

a plurality of developer devices, each of which is provided for one of the electrostatic latent image carriers and configured to rotate in a predetermined direction to supply developer agent in one of the different colors to apply to the electrostatic latent image formed on the surface of the electrostatic latent image carrier;

an endless belt configured to roll continuously and having an opposing section in a position opposite from the plurality of electrostatic latent image carriers to transfer the developer agent adhered on the surfaces of the electrostatic latent image carriers to a recording medium in cooperation with the electrostatic latent image carriers and the developer devices;

a medium feeder, which includes a plurality of conveying rollers configured to convey the recording medium to the opposing section of the endless belt;

a first motor configured to generate driving force;

a first gear train, which includes a plurality of gears and at least one one-way clutch and is configured to transmit the driving force from the first motor to at least one of the conveying rollers and to at least one of the developer devices;

a second motor configured to generate driving force separately from the first motor; and a second gear train configured to transmit the driving force generated in the second motor to remaining ones of the developer devices other than the at least one developer device coupled with the first gear train, wherein the at least one one-way clutch is in an intervening position between a gear coupled with the conveying rollers and a gear coupled with the at least one of the developer devices, and is configured to transmit driving force to rotate the at least one of the developer devices in the predetermined direction to the gear coupled with the conveying rollers and to the gear coupled with the at least one of the developer devices; and wherein the at least one one-way clutch absorbs driving force capable of rotating the at least one of the developer devices in a direction opposite from the predetermined direction within the first gear train.

9. An image forming apparatus, comprising:

an image forming unit configured to form an image on a sheet in an electrophotographic process, comprising:

a plurality of electrostatic latent image carriers, each of which is provided for forming an image in one of different colors and configured to have an electrostatic latent image formed on a surface thereof in the one of different colors; and a plurality of developer devices, each of which is provided for one of the electrostatic latent image carriers and configured to supply developer agent in one of the different colors to apply the electrostatic latent image formed on the surface of the electrostatic latent image carrier;

an endless belt;

a cleaning roller configured to clean the endless belt;

a motor configured to be rotatable in a first direction and a second direction being a reverse direction from the first direction to generate driving force;

a transmitting unit, which is configured to transmit the driving force from the motor to the cleaning roller to rotate the cleaning roller; and a gear train, which is configured to couple the image forming unit with the motor to transmit the driving force from the motor to at least one of the developer devices in the image forming unit to drive the at least one of the developer devices when the motor rotates in the first direction and to decouple the at least one of the developer devices in the image forming unit from the motor when the motor rotates in the second direction; and a sheet feeding unit configured to feed the sheet in the image forming unit, and wherein the transmitting unit is configured to rotate the cleaning roller in the first direction if the motor rotates in the first direction and rotate the cleaning roller in the first direction if the motor rotates in the second direction; and wherein the driving force transmitted from the gear train drives the sheet feeding unit.

10. The image forming apparatus according to claim 9, wherein the transmitting unit comprises;

a first transmitter comprising a first end and a second end, the first end of the first transmitter being coupled to the cleaning roller;

a second transmitter comprising a first end and a second end, the first end of the second transmitter being coupled to the cleaning roller; and a switching unit driven by the motor and configured to selectively transmit the driving force from the motor to one of the second end of the first transmitter and the second end of the second transmitter;

wherein the switching unit transmits the driving force from the motor to the second end of the first transmitter if the motor rotates in the first direction, and wherein the switching unit transmits the driving force from the motor to the second end of the second transmitter if the motor rotates in the second direction.

11. The image forming apparatus according to claim 10, wherein the first transmitter comprises a first gear train having an odd number of gears;

wherein the second transmitter comprises a second gear train having an even number of gears; and wherein the switching unit comprises a pendulum gear, which is coupled to a gear at an end of the first gear train if the motor rotates in the first direction and is coupled to a gear at an end of the second gear train if the motor rotates in the second direction.

* * * * *